US010851676B2

(12) United States Patent
Ikeguchi et al.

(10) Patent No.: US 10,851,676 B2
(45) Date of Patent: Dec. 1, 2020

(54) EXHAUST DIFFUSER

(71) Applicant: KAWASAKI JUKOGYO KABUSHIKI KAISHA, Kobe (JP)

(72) Inventors: Takuya Ikeguchi, Kobe (JP); Koji Terauchi, Kobe (JP); Keiji Oikaze, Akashi (JP); Naoto Sakai, Osaka (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 118 days.

(21) Appl. No.: 15/755,915

(22) PCT Filed: Aug. 30, 2016

(86) PCT No.: PCT/JP2016/003958
§ 371 (c)(1),
(2) Date: Feb. 27, 2018

(87) PCT Pub. No.: WO2017/038086
PCT Pub. Date: Mar. 9, 2017

(65) Prior Publication Data

US 2018/0328230 A1 Nov. 15, 2018

(30) Foreign Application Priority Data

Aug. 31, 2015 (JP) ..... 2015-170156

(51) Int. Cl.
*F01D 25/30* (2006.01)
*F01D 25/16* (2006.01)
*F01D 9/04* (2006.01)

(52) U.S. Cl.
CPC ..... *F01D 25/30* (2013.01); *F01D 9/04* (2013.01); *F01D 25/162* (2013.01);
(Continued)

(58) Field of Classification Search
CPC ..... F01D 25/30; F01D 25/162
See application file for complete search history.

(56) References Cited

U.S. PATENT DOCUMENTS 2,110,679 A * 3/1938 Robinson ..... F01D 5/141 416/189
2,622,790 A * 12/1952 McLeod ..... F01D 9/042 415/209.1

(Continued)

FOREIGN PATENT DOCUMENTS

CN 103261631 A 8/2013
EP 2584152 A2 * 4/2013

(Continued)

OTHER PUBLICATIONS

International Search Report for PCT/JP2016/003958 dated Oct. 11, 2016 [PCT/ISA/210].

*Primary Examiner* — Moshe Wilensky
*Assistant Examiner* — Brian Christopher Delrue
(74) *Attorney, Agent, or Firm* — Sughrue Mion, PLLC

(57) ABSTRACT

An exhaust diffuser includes: an internal cylinder; an external cylinder that forms an exhaust passage between the internal cylinder and the external cylinder, the exhaust passage expanding from front to rear; and at least one tubular strut that couples the internal cylinder and the external cylinder together. The external cylinder includes: a front conical portion that is positioned forward of the tubular strut; and an outer flaring portion that starts flaring at a positon forward of the tubular strut at an inclination angle that is greater than an inclination angle of the front conical portion. The internal cylinder includes: a front straight portion that faces the front conical portion and the outer flaring portion; and an inner flaring portion that starts flaring at a position between a maximum width portion and a trailing edge of the tubular strut.

13 Claims, 4 Drawing Sheets

(52) U.S. Cl.
CPC ..... *F05D 2220/32* (2013.01); *F05D 2230/21* (2013.01); *F05D 2240/128* (2013.01); *F05D 2250/231* (2013.01); *F05D 2250/232* (2013.01)

(56) References Cited

U.S. PATENT DOCUMENTS 3,024,969 A * 3/1962 Russell ..... F01D 9/065 415/210.1
3,075,744 A * 1/1963 Peterson ..... F01D 5/182 415/115
3,286,461 A * 11/1966 Johnson ..... F01D 5/081 60/787
3,800,864 A * 4/1974 Hauser ..... F01D 25/12 165/47
3,965,066 A * 6/1976 Sterman ..... F01D 9/023 60/800
4,292,008 A * 9/1981 Grosjean ..... F01D 5/186 415/115
4,375,891 A * 3/1983 Pask ..... F01D 11/025 277/384
4,464,094 A * 8/1984 Gerken ..... B23P 15/006 164/122
4,642,024 A * 2/1987 Weidner ..... F01D 11/08 415/116
4,821,522 A * 4/1989 Matthews ..... F01D 9/023 415/175
5,197,856 A * 3/1993 Koertge ..... F01D 25/246 415/199.4
5,332,360 A * 7/1994 Correia ..... F01D 9/042 29/889.21
5,398,496 A * 3/1995 Taylor ..... F01D 9/023 60/752
5,470,198 A * 11/1995 Harrogate ..... F01D 9/023 415/115
6,164,903 A * 12/2000 Kouris ..... F01D 9/04 415/135
6,368,055 B1 4/2002 Matsuda
6,431,824 B2 * 8/2002 Schotsch ..... F01D 9/02 415/115
6,439,841 B1 * 8/2002 Bosel ..... F01D 9/065 415/142
6,854,738 B2 * 2/2005 Matsuda ..... F01D 9/023 277/632
6,860,716 B2 * 3/2005 Czachor ..... F01D 25/162 415/142
6,884,030 B2 * 4/2005 Darkins, Jr. ..... F01D 9/042 29/889.22
6,988,369 B2 * 1/2006 Conete ..... F23R 3/007 60/796
7,004,720 B2 * 2/2006 Synnott ..... F01D 9/041 415/115
7,114,339 B2 * 10/2006 Alvanos ..... F01D 5/081 60/806
7,114,917 B2 * 10/2006 Legg ..... F01D 9/04 415/137
7,360,988 B2 * 4/2008 Lee ..... F01D 9/00 29/889.22
7,452,182 B2 * 11/2008 Vance ..... F01D 5/14 415/135
7,452,184 B2 * 11/2008 Durocher ..... F01D 5/081 415/115
7,527,469 B2 * 5/2009 Zborovsky ..... F01D 9/041 277/412
7,553,126 B2 * 6/2009 Charier ..... F01D 17/14 415/128
7,726,131 B2 * 6/2010 Sze ..... F23R 3/002 60/754
7,836,702 B2 * 11/2010 Grivas ..... F01D 9/023 415/139
7,976,274 B2 * 7/2011 Lee ..... F01D 5/143 415/190
8,177,488 B2 * 5/2012 Manteiga ..... F01D 9/065 415/108
8,388,307 B2 * 3/2013 Smoke ..... F01D 9/02 415/134
8,783,044 B2 * 7/2014 Steiger ..... F01D 5/186 415/115
8,950,192 B2 * 2/2015 Tschuor ..... F01D 9/023 60/800
9,097,141 B2 * 8/2015 Paradis ..... F01D 25/243
9,115,593 B2 * 8/2015 Suciu ..... F02C 7/047
9,200,536 B2 * 12/2015 McCaffrey ..... F01D 25/162
9,311,445 B2 * 4/2016 Nanda ..... F01D 25/30
9,732,674 B2 * 8/2017 Sakamoto ..... F02C 7/00
9,752,447 B2 * 9/2017 Clum ..... F01D 9/023
9,777,595 B2 * 10/2017 Sheridan ..... F01D 25/12
9,828,914 B2 * 11/2017 Suciu ..... F02C 7/06
10,060,291 B2 * 8/2018 Kumar ..... F01D 25/162
10,087,847 B2 * 10/2018 Szymanski ..... F01D 9/065
2005/0254942 A1 * 11/2005 Morrison ..... F01D 5/282 415/200
2006/0010852 A1 * 1/2006 Gekht ..... B23K 15/0093 60/262
2007/0140845 A1 * 6/2007 Marke ..... F01D 9/06 415/232
2008/0199661 A1 * 8/2008 Keller ..... B32B 18/00 428/188
2008/0307795 A1 * 12/2008 Bader ..... F01D 25/30 60/797
2010/0132371 A1 * 6/2010 Durocher ..... F01D 9/065 60/796
2010/0132372 A1 * 6/2010 Durocher ..... F01D 9/065 60/796
2010/0132374 A1 * 6/2010 Manteiga ..... F01D 9/02 60/796
2010/0132376 A1 * 6/2010 Durocher ..... F01D 9/065 60/797
2010/0135770 A1 * 6/2010 Durocher ..... F01D 9/065 415/69
2010/0275572 A1 * 11/2010 Durocher ..... F01D 9/065 60/39.08
2010/0275614 A1 * 11/2010 Fontaine ..... F01D 25/162 60/797
2011/0005234 A1 * 1/2011 Hashimoto ..... F01D 25/30 60/796
2011/0081237 A1 * 4/2011 Durocher ..... F01D 9/06 415/173.1
2011/0252808 A1 * 10/2011 McKenney ..... F01D 25/164 60/796
2012/0297791 A1 * 11/2012 Suciu ..... F01D 9/041 60/796
2013/0111906 A1 * 5/2013 Bouchard ..... F02K 1/827 60/694
2013/0259670 A1 * 10/2013 Sakamoto ..... F02C 7/00 415/207
2014/0013771 A1 * 1/2014 Farah ..... F02C 7/20 60/797
2014/0142898 A1 * 5/2014 Nanda ..... F01D 25/30 703/1
2014/0248152 A1 * 9/2014 Chuong ..... F01D 25/162 416/95
2015/0007580 A1 * 1/2015 Bellabal ..... F02C 7/20 60/797
2015/0143815 A1 * 5/2015 Salunkhe ..... F01D 25/28 60/796
2015/0143816 A1 * 5/2015 Salunkhe ..... F02K 1/04 60/796
2015/0308343 A1 * 10/2015 Scott ..... F01D 25/30 60/796
2015/0315925 A1 * 11/2015 Budnick ..... F02C 7/28 415/214.1
2016/0230576 A1 * 8/2016 Freeman ..... F01D 9/041
2016/0281721 A1 * 9/2016 Army, Jr. ..... F04D 17/16
2016/0290147 A1 * 10/2016 Weaver ..... F02C 3/04

(56) References Cited

U.S. PATENT DOCUMENTS

FOREIGN PATENT DOCUMENTS

| | | | |
|---|---|---|---|
| EP | 2746535 | A1 | 6/2014 |
| EP | 2831383 | B1 | 9/2017 |
| JP | 2014-077441 | A | 5/2014 |
| JP | 2014-122622 | A | 7/2014 |

* cited by examiner

EXHAUST DIFFUSER

CROSS REFERENCE TO RELATED APPLICATIONS

This application is a National Stage of International Application No. PCT/JP2016/003958 filed Aug. 30, 2016, claiming priority based on Japanese Patent Application No. 2015-170156 filed Aug. 31, 2015, the disclosure of which is incorporated in its entirety.

TECHNICAL FIELD

The present invention relates to an exhaust diffuser.

BACKGROUND ART

Conventionally, an exhaust diffuser that converts the dynamic pressure of exhaust gas from a turbine into static pressure is disposed downstream of the turbine. For example, Patent Literature 1 discloses an exhaust diffuser incorporated in a gas turbine engine.

In the exhaust diffuser disclosed in Patent Literature 1, an internal cylinder and an external cylinder are coupled together by a plurality of struts. Between the internal cylinder and the external cylinder, an exhaust passage expanding from front to rear is formed. Each strut is plate-shaped in the same manner, and the struts are arranged at a regular angular pitch on the same circumference.

CITATION LIST

Patent Literature

PTL 1: Japanese Laid-Open Patent Application Publication No. 2014-77441

SUMMARY OF INVENTION

Technical Problem

There are cases where some of the plurality of struts are formed to be tubular, and pipes or the like are passed through such tubular struts. However, in a case where some of the struts are made tubular and thick, pressure loss is great in a region where such tubular struts are present.

In view of the above, an object of the present invention is to provide an exhaust diffuser that includes a tubular strut and that is capable of reducing the pressure loss caused by the tubular strut.

Solution to Problem

In order to solve the above-described problems, an exhaust diffuser according to one aspect of the present invention includes: an internal cylinder; an external cylinder that forms an exhaust passage between the internal cylinder and the external cylinder, the exhaust passage expanding from front to rear; and at least one tubular strut that couples the internal cylinder and the external cylinder together. The external cylinder includes: a front conical portion that is positioned forward of the tubular strut; and an outer flaring portion that starts flaring at a positon forward of the tubular strut at an inclination angle that is greater than an inclination angle of the front conical portion. The internal cylinder includes: a front straight portion that faces the front conical portion and the outer flaring portion; and an inner flaring portion that starts flaring at a position between a maximum width portion and a trailing edge of the tubular strut.

The term "front" or "forward" herein refers to one side of the exhaust diffuser in its axial direction (the upstream side of a flow of exhaust gas), and the term "rear" or "rearward" herein refers to the other side of the exhaust diffuser in the axial direction (the downstream side of the flow of exhaust gas).

According to the above configuration, since the exhaust passage is expanded by the outer flaring portion at a position forward of the tubular struts, the exhaust gas flowing through the exhaust passage flows into between the tubular struts after the velocity of the exhaust gas is sufficiently reduced. This makes it possible to reduce pressure loss near leading edges of the tubular struts. Here, assume that the inner flaring portion is absent. In this case, rearward of the maximum width portions of the tubular struts, the cross-sectional area of the exhaust passage suddenly increases due to reduction in the area occupied by the tubular struts. In this respect, if the inner flaring portion is present, such sudden increase in the cross-sectional area of the exhaust passage can be eased by the presence of the inner flaring portion. This makes it possible to reduce pressure loss also near the trailing edges of the tubular struts.

Part of the external cylinder and part of the internal cylinder may be formed integrally with the tubular strut by casting. This configuration makes it possible to realize the exhaust diffuser that is suitable for middle-size and small-size gas turbine engines.

The external cylinder may include: an outer straight portion that extends rearward from a rear end of the outer flaring portion beyond the maximum width portion of the tubular strut; and a rear conical portion that expands in diameter from a rear end of the outer straight portion. The internal cylinder may include a rear straight portion that extends rearward from a rear end of the inner flaring portion. According to this configuration, the external cylinder is not provided with a recess that is recessed radially outward from the exhaust passage, and the internal cylinder is not provided with a recess that is recessed radially inward from the exhaust passage. This makes it possible to reduce the number of mold segments when manufacturing part of the external cylinder and part of the internal cylinder together with the tubular strut by casting.

The above exhaust diffuser may further include at least one flattened strut that couples the internal cylinder and the external cylinder together and that overlaps with the tubular strut in an axial direction of the exhaust diffuser. According to this configuration, a thin strut can be adopted at a position where no pipes or the like are present, and thereby the cross-sectional area of the exhaust passage can be increased. This makes it possible to reduce the pressure loss compared to a case where all the struts are tubular struts.

A leading edge of the flattened strut may be positioned forward of a leading edge of the tubular strut, and a trailing edge of the flattened strut may be positioned rearward of the maximum width portion of the tubular strut. According to this configuration, the cross-sectional area of the exhaust passage is reduced by the flattened strut to a small degree and then reduced by the tubular strut to a great degree. In this way, the cross-sectional area of the exhaust passage can be changed in a gradual manner. This makes it possible to reduce the pressure loss compared to a case where the leading edge of the tubular strut coincides with the leading edge of the flattened strut.

The trailing edge of the flattened strut may be positioned forward of the trailing edge of the tubular strut. According to this configuration, streams of the exhaust gas flowing through the exhaust passage merge together near the trailing edge of the flattened strut and then further merge together near the trailing edge of the tubular strut. This makes it possible to stabilize the flow.

An exhaust diffuser according to another aspect of the present invention includes: an internal cylinder; an external cylinder that forms an exhaust passage between the internal cylinder and the external cylinder, the exhaust passage expanding from front to rear; at least one tubular strut that couples the internal cylinder and the external cylinder together; and at least one flattened strut that couples the internal cylinder and the external cylinder together and that overlaps with the tubular strut in an axial direction of the exhaust diffuser. A leading edge of the flattened strut is positioned forward of a leading edge of the tubular strut, and a trailing edge of the flattened strut is positioned rearward of a maximum width portion of the tubular strut.

According to the above configuration, the cross-sectional area of the exhaust passage is reduced by the flattened strut to a small degree and then reduced by the tubular strut to a great degree. In this way, the cross-sectional area of the exhaust passage can be changed in a gradual manner. This makes it possible to reduce the pressure loss compared to a case where the leading edge of the tubular strut coincides with the leading edge of the flattened strut.

In the exhaust diffuser according to the above other aspect, the trailing edge of the flattened strut may be positioned forward of a trailing edge of the tubular strut. According to this configuration, streams of the exhaust gas flowing through the exhaust passage merge together near the trailing edge of the flattened strut and then further merge together near the trailing edge of the tubular strut. This makes it possible to stabilize the flow.

In the exhaust diffuser according to the above other aspect, part of the external cylinder and part of the internal cylinder may be formed integrally with the tubular strut by casting. This configuration makes it possible to realize the exhaust diffuser that is suitable for middle-size and small-size gas turbine engines.

Advantageous Effects of Invention

According to the present invention, the exhaust diffuser including a tubular strut is capable of reducing the pressure loss caused by the tubular strut.

DESCRIPTION OF EMBODIMENTS

Figure 1:
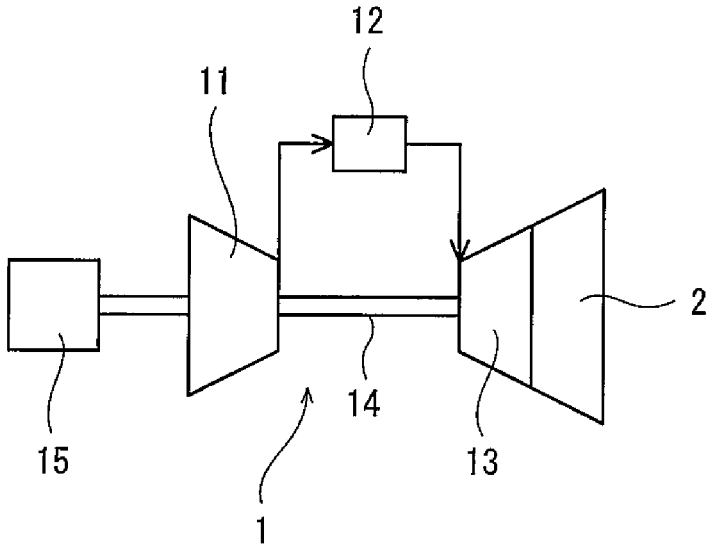
FIG. 1 shows a schematic configuration of a gas turbine engine in which an exhaust diffuser according to one embodiment of the present invention is incorporated.

FIG. 1 shows a gas turbine engine 1, in which an exhaust diffuser 2 according to one embodiment of the present invention is incorporated. Hereinafter, one side of the exhaust diffuser 2 in its axial direction (the upstream side of a flow of exhaust gas) (the axial direction is the horizontal direction in the present embodiment) is referred to as front or forward, and the other side of the exhaust diffuser 2 in the axial direction (the downstream side of the flow of exhaust gas) is referred to as rear or rearward.

The gas turbine engine 1 includes a compressor 11, a combustion chamber 12, and a turbine 13. The exhaust diffuser 2 is disposed downstream of the turbine 13. The gas turbine engine 1 includes a rotor 14, which penetrates the compressor 11 and the turbine 13. A power generator 15 is connected to the front end of the rotor 14.

Figure 2:
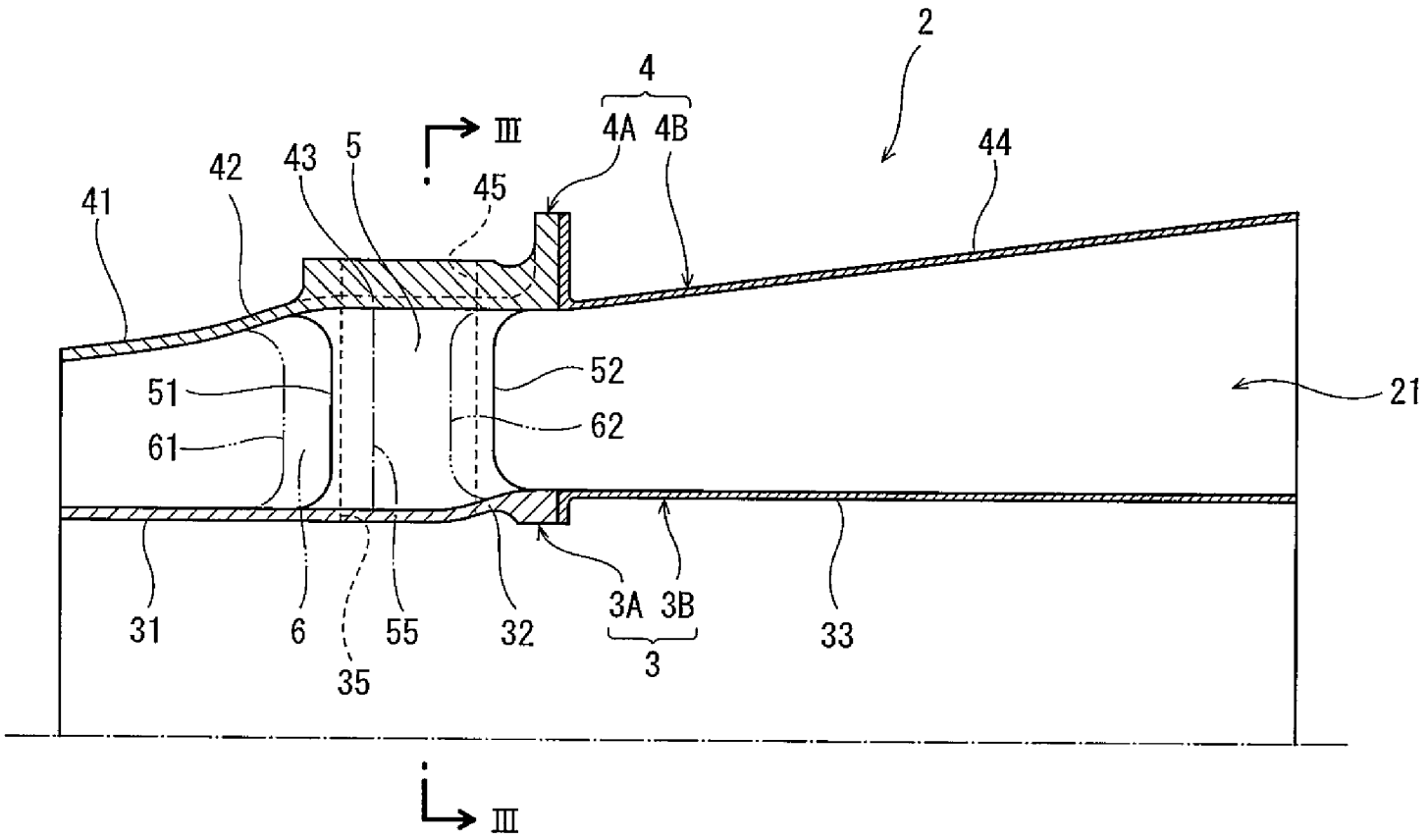
FIG. 2 is a sectional view of the exhaust diffuser.
Figure 3:
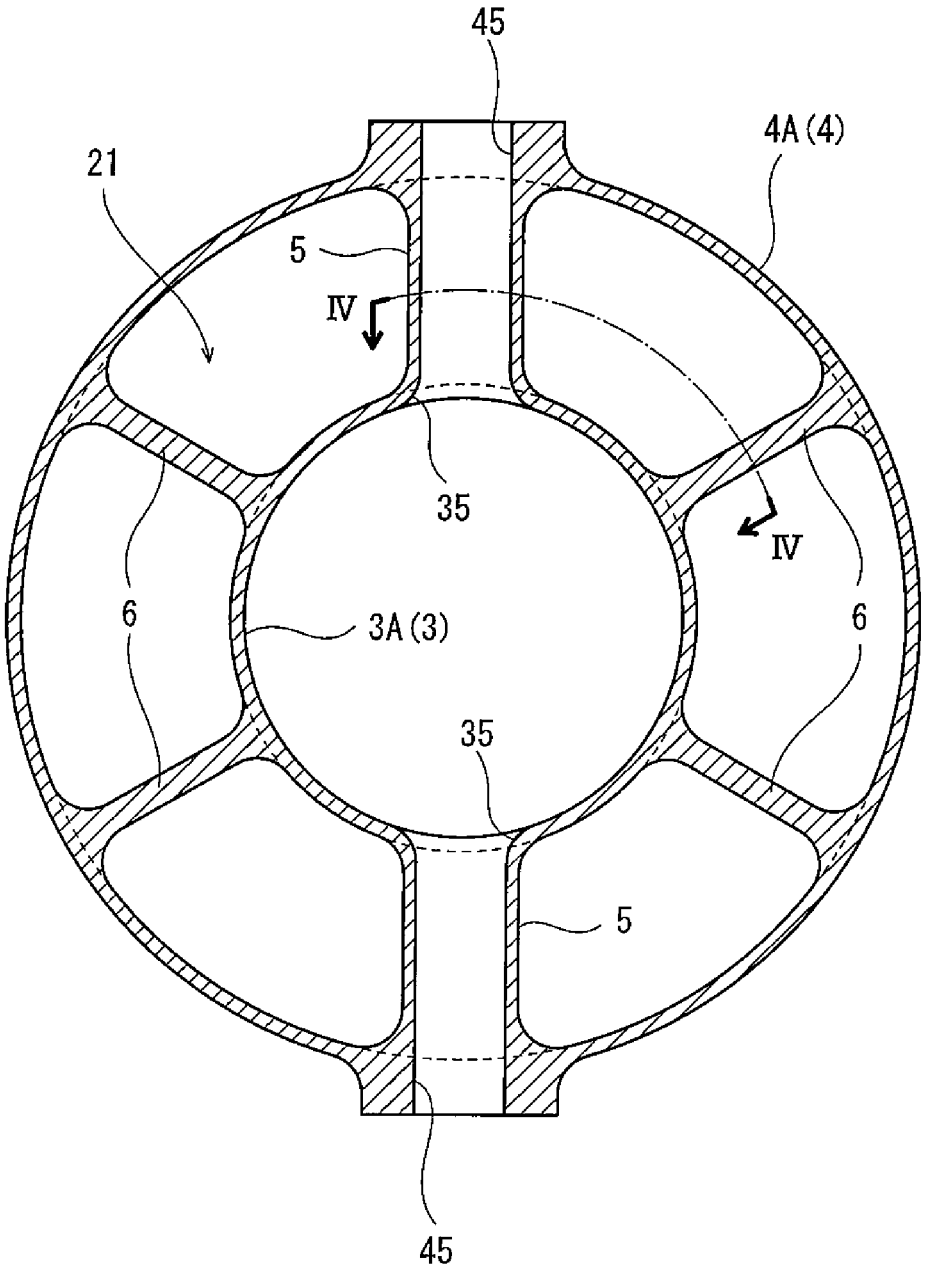
FIG. 3 is a sectional view taken along line III-III of FIG. 2.

As shown in FIG. 2 and FIG. 3, the exhaust diffuser 2 includes an internal cylinder 3 and an external cylinder 4. Between the internal cylinder 3 and the external cylinder 4, an exhaust passage 21 expanding from front to rear is formed. In the present embodiment, the internal cylinder 3 and the external cylinder 4 are coupled together by a plurality of (in the illustrated example, two) tubular struts 5 extending in the radial direction of the exhaust diffuser 2 and a plurality of (in the illustrated example, four) flattened struts 6 extending in the radial direction of the exhaust diffuser 2. However, the minimum necessary number of tubular struts 5 and the minimum necessary number of flattened struts 6 are both one, and the number of tubular struts 5 and the number of flattened struts 6 may be set arbitrarily.

The tubular struts 5 and the flattened struts 6 are arranged in the circumferential direction of the exhaust diffuser 2. Each of the flattened struts 6 is parallel to the radial direction of the exhaust diffuser 2. However, as an alternative, each flattened strut 6 may be inclined relative to the radial direction of the exhaust diffuser 2. In the present embodiment, one of the two tubular struts 5 is disposed on the upper side of the internal cylinder 3; the other tubular strut 5 is disposed on the lower side of the internal cylinder 3; and two flattened struts 6 are disposed on each of the right side and the left side of the internal cylinder 3.

The exhaust diffuser 2 of the present embodiment is suitable for middle-size and small-size gas turbine engines. For this reason, part of the external cylinder 4 and part of the internal cylinder 3 are formed integrally with the tubular struts 5 and the flattened struts 6 by casting.

To be more specific, the external cylinder 4 is divided into a front piece 4A and a rear piece 4B, and the internal cylinder 3 is divided into a front piece 3A and a rear piece 3B. The front piece 4A of the external cylinder 4 and the front piece 3A of the internal cylinder 3 are formed integrally with the tubular struts 5 and the flattened struts 6 by casting. Each of the rear piece 4B of the external cylinder 4 and the rear piece 3B of the internal cylinder 3 is manufactured by, for example, sheet metal working.

In the present embodiment, the flattened struts 6 protrude forward of the tubular struts 5. In other words, the flattened struts 6 partly overlap the tubular struts 5 in the axial direction of the exhaust diffuser 2.

Figure 4:
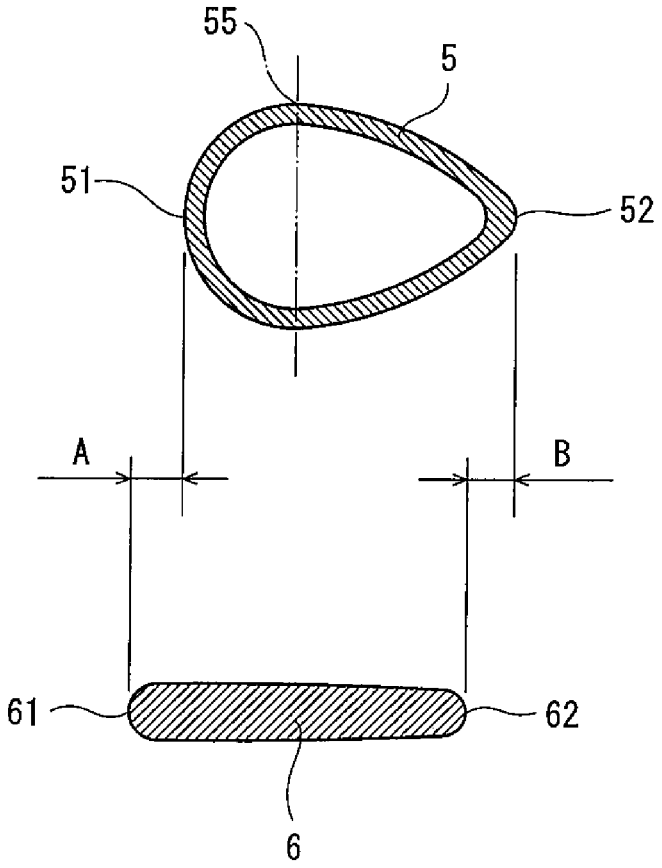
FIG. 4 is a sectional view taken along line IV-IV of FIG. 3.

To be more specific, as shown in FIG. 4, the sectional shape of each tubular strut 5 is a droplet-like shape with a pointy rear side. A portion of the tubular strut 5 forward of a maximum width portion 55 of the tubular strut 5 has a semicircular shape, and a portion of the tubular strut 5 rearward of the maximum width portion 55 is substantially V-shaped. The term "width" herein means the thickness of the tubular strut 5 in the circumferential direction of the exhaust diffuser 2. The front piece 4A of the external cylinder 4 and the front piece 3A of the internal cylinder 3 are provided with openings 45 and openings 35, respectively (see FIGS. 2 and 3). The shape of each of the openings 45 and 35 is the same as the shape of the inner space of the tubular strut 5.

Leading edges 61 of the flattened struts 6 are positioned forward of leading edges 51 of the tubular struts 5 by a distance A. Trailing edges 62 of the flattened struts 6 are positioned forward of trailing edges 52 of the tubular struts 5 by a distance B. It should be noted that the trailing edges 62 of the flattened struts 6 are positioned rearward of the maximum width portions 55 of the tubular struts 5. The term "leading edge" herein means a linear edge of a portion of each of the tubular struts 5 and the flattened struts 6, the portion having a constant sectional shape, and the term "trailing edge" herein also means a linear edge of a portion of each of the tubular struts 5 and the flattened struts 6, the portion having a constant sectional shape.

Returning to FIG. 2, the external cylinder 4 includes a front conical portion 41, an outer flaring portion 42, an outer straight portion 43, and a rear conical portion 44, which are arranged in this order from the front side of the external cylinder 4. These portions 41 to 44 form a continuous inward wall surface. That is, the front end of the front conical portion 41 is the front end of the external cylinder 4, and the rear end of the rear conical portion 44 is the rear end of the external cylinder 4. Among these portions 41 to 44, adjoining rear and front ends of the adjoining portions are connected to each other. The front conical portion 41, the outer flaring portion 42, and the outer straight portion 43 are components of the front piece 4A, and the rear conical portion 44 is a component of the rear piece 4B.

The front conical portion 41 is positioned forward of the tubular struts 5 and the flattened struts 6. The front conical portion 41 expands in diameter rearward at a relatively gentle inclination angle.

The outer flaring portion 42 starts flaring at a position forward of the tubular struts 5 and the flattened struts 6 at an inclination angle that is greater than the inclination angle of the front conical portion 41. In the present embodiment, the rear end of the outer flaring portion 42 is positioned rearward of the leading edges 51 of the tubular struts 5. However, as an alternative, the position of the rear end of the outer flaring portion 42 may be the same as the positions of the leading edges 51 of the tubular struts 5, or the rear end of the outer flaring portion 42 may be positioned forward of the leading edges 51 of the tubular struts 5.

For example, the outer flaring portion 42 expands the diameter of the external cylinder 4, such that reduction in the cross-sectional area of the exhaust passage 21 due to the tubular struts 5 near the leading edges 51 of the tubular struts 5 (and also, in some cases, reduction in the cross-sectional area of the exhaust passage 21 due to the flattened struts 6 near the leading edges 61 of the flattened struts 6) is offset (but not necessarily reduced to zero).

The outer straight portion 43 extends rearward from the rear end of the outer flaring portion 42 beyond the maximum width portions 55 of the tubular struts 5. In the present embodiment, the rear end of the outer straight portion 43 is positioned rearward of the trailing edges 52 of the tubular struts 5. However, as an alternative, the position of the rear end of the outer straight portion 43 may the same as the positions of the trailing edges 52 of the tubular struts 5, or the rear end of the outer straight portion 43 may be positioned forward of the trailing edges 52 of the tubular struts 5.

The rear conical portion 44 expands in diameter rearward from the rear end of the outer straight portion 43. The inclination angle of the rear conical portion 44 may be the same as or different from the inclination angle of the front conical portion 41.

Meanwhile, the internal cylinder 3 includes a front straight portion 31, an inner flaring portion 32, and a rear straight portion 33, which are arranged in this order from the front side of the internal cylinder 3. These portions 31 to 33 form a continuous outward wall surface. That is, the front end of the front straight portion 31 is the front end of the internal cylinder 3, and the rear end of the rear straight portion 33 is the rear end of the internal cylinder 3. Among these portions 31 to 33, adjoining rear and front ends of the adjoining portions are connected to each other. The front straight portion 31 and the inner flaring portion 32 are components of the front piece 3A, and the rear straight portion 33 is a component of the rear piece 3B.

The front straight portion 31 extends rearward from the front end of the internal cylinder 3 beyond the maximum width portions 55 of the tubular struts 5. Accordingly, the front straight portion 31 faces the entirety of the front conical portion 41 and the outer flaring portion 42 of the external cylinder 4, and also faces part of the outer straight portion 43.

The inner flaring portion 32 starts flaring at a position between the maximum width portions 55 and the trailing edges 52 of the tubular struts 5. The rear end of the inner flaring portion 32 is positioned rearward of the trailing edges 52 of the tubular struts 5.

For example, the inner flaring portion 32 expands the diameter of the internal cylinder 3, such that increase in the cross-sectional area of the exhaust passage 21 due to the tubular struts 5 near the trailing edges 52 of the tubular struts 5 (and also, in some cases, increase in the cross-sectional area of the exhaust passage 21 due to the flattened struts 6 near the trailing edges 62 of the flattened struts 6) is offset (but not necessarily reduced to zero).

The rear straight portion 33 extends rearward from the rear end of the inner flaring portion 32, and faces the rear conical portion 44 of the external cylinder 4.

As described above, in the exhaust diffuser 2 of the present embodiment, since the exhaust passage 21 is expanded by the outer flaring portion 42 at a position forward of the tubular struts 5, the exhaust gas flowing through the exhaust passage 21 flows into between the tubular struts 5 after the velocity of the exhaust gas is sufficiently reduced. This makes it possible to reduce pressure loss near the leading edges 51 of the tubular struts 5. Here, assume that the inner flaring portion 32 is absent. In this case, rearward of the maximum width portions 55 of the tubular struts 5, the cross-sectional area of the exhaust passage 21 suddenly increases due to reduction in the area occupied by the tubular struts 5. In this respect, if the inner flaring portion 32 is present, such sudden increase in the cross-sectional area of the exhaust passage 21 can be eased by the presence of the inner flaring portion 32. This makes it possible to reduce pressure loss also near the trailing edges 52 of the tubular struts 5.

Moreover, in the present embodiment, since the leading edges 61 of the flattened struts 6 are positioned forward of the leading edges 51 of the tubular struts 5, the cross-sectional area of the exhaust passage 21 is reduced by the flattened struts 6 to a small degree and then reduced by the tubular struts 5 to a great degree. In this way, the cross-sectional area of the exhaust passage 21 can be changed in a gradual manner. This makes it possible to reduce the pressure loss compared to a case where the leading edges 51 of the tubular struts 5 coincide with the leading edges 61 of the flattened struts 6.

Furthermore, since the trailing edges 62 of the flattened struts 6 are positioned forward of the trailing edges 52 of the tubular struts 5, streams of the exhaust gas flowing through the exhaust passage 21 merge together near the trailing edges 62 of the flattened struts 6 and then further merge together near the trailing edges 52 of the tubular struts 5. This makes it possible to stabilize the flow.

Further, in the present embodiment, the external cylinder 4 is not provided with a recess that is recessed radially outward from the exhaust passage 21, and the internal cylinder 3 is not provided with a recess that is recessed radially inward from the exhaust passage. This makes it possible to reduce the number of mold (e.g., wooden mold) segments when manufacturing the front piece 4A of the external cylinder 4 and the front piece 3A of the internal cylinder 3 together with the tubular struts 5 and the flattened struts 6 by casting.

(Variations)

The present invention is not limited to the above-described embodiment. Various modifications can be made without departing from the spirit of the present invention.

For example, it is not essential that the exhaust diffuser 2 be incorporated in the gas turbine engine 1. For example, the exhaust diffuser 2 may be disposed downstream of a steam turbine.

It is also not essential that the flattened struts 6 partly overlap with the tubular struts 5 in the axial direction of the exhaust diffuser 2. Alternatively, the flattened struts 6 may fully overlap with the tubular struts 5.

The flattened struts 6 are not essential components, and only the plurality of tubular struts 5 may be provided. However, if at least one tubular strut 5 and at least one flattened strut 6 are provided as in the above-described embodiment, a thin strut can be adopted at a position where no pipes or the like are present, and thereby the cross-sectional area of the exhaust passage 21 can be increased. This makes it possible to reduce the pressure loss compared to a case where all the struts are tubular struts 5.

The front end of the outer flaring portion 42 may be positioned rearward of the leading edges 61 of the flattened struts 6. However, if the front end of the outer flaring portion 42 is positioned forward of the leading edges 61 of the flattened struts 6 as in the above-described embodiment, the velocity of the exhaust gas flowing into between the flattened struts 6 can be reduced.

It is not essential that the trailing edges 62 of the flattened struts 6 be positioned forward of the trailing edges 52 of the tubular struts 5, and the positions of the trailing edges 62 of the flattened struts 6 may coincide with the positions of the trailing edges 52 of the tubular struts 5, or the trailing edges 62 of the flattened struts 6 may be positioned rearward of the trailing edges 52 of the tubular struts 5.

Although not illustrated, a middle conical portion having the same inclination angle as that of the rear conical portion 44 may be provided instead of the outer straight portion 43 of the external cylinder 4. In addition, a conical portion whose diameter starts decreasing from the rear end of the inner flaring portion 32 may be adopted instead of the rear straight portion 33 of the internal cylinder 3, and at the same time, a straight portion may be adopted instead of the rear conical portion 44 of the external cylinder 4.

Each of the front piece 4A of the external cylinder 4 and the front piece 3A of the internal cylinder 3 may be manufactured by sheet metal working. Each of the external cylinder 4 and the internal cylinder 3 may be a single member.

Focusing attention on the positional relationship between the tubular struts 5 and the flattened struts 6 in the above-described embodiment, the external cylinder 4 need not include the outer flaring portion 42, and also, the internal cylinder 3 need not include the inner flaring portion 32. Specifically, since the leading edges 61 of the flattened struts 6 are positioned forward of the leading edges 51 of the tubular struts 5 in the above-described embodiment, the cross-sectional area of the exhaust passage 21 is reduced by the flattened struts 6 to a small degree and then reduced by the tubular struts 5 to a great degree. In this way, the cross-sectional area of the exhaust passage 21 can be changed in a gradual manner. This makes it possible to reduce the pressure loss compared to a case where the leading edges 51 of the tubular struts 5 coincide with the leading edges 61 of the flattened struts 6. Thus, when focusing attention on the positional relationship between the tubular struts 5 and the flattened struts 6 in the above-described embodiment, the internal cylinder 3 and the external cylinder 4 may have any shape, so long as the exhaust passage 21 formed therebetween expands from front to rear.

Even when focusing attention on the positional relationship between the tubular struts 5 and the flattened struts 6 in the above-described embodiment, it is not essential that the trailing edges 62 of the flattened struts 6 be positioned forward of the trailing edges 52 of the tubular struts 5, and the positions of the trailing edges 62 of the flattened struts 6 may coincide with the positions of the trailing edges 52 of the tubular struts 5, or the trailing edges 62 of the flattened struts 6 may be positioned rearward of the trailing edges 52 of the tubular struts 5. The entirety of each of the external cylinder 4 and the internal cylinder 3 may be manufactured by sheet metal working, and also, each of the external cylinder 4 and the internal cylinder 3 may be a single member.

REFERENCE SIGNS LIST

2 exhaust diffuser
21 exhaust passage
3 internal cylinder
31 from straight portion
32 inner flaring portion
33 rear straight portion
4 external cylinder
41 front conical portion
42 outer flaring portion
43 outer straight portion
44 rear conical portion
5 tubular strut
51 leading edge
52 trailing edge
55 maximum width portion
6 flattened strut
61 leading edge
62 trailing edge

The invention claimed is:

1. An exhaust diffuser comprising:

an internal cylinder;

an external cylinder that forms an exhaust passage between the internal cylinder and the external cylinder, the exhaust passage expanding from front to rear; and at least one tubular strut that couples the internal cylinder and the external cylinder together, wherein the external cylinder includes:

a front conical portion that is positioned forward of the tubular strut; and an outer flaring portion that starts flaring at a positon forward of the tubular strut at an inclination angle that is greater than an inclination angle of the front conical portion, and the internal cylinder includes:

a front straight portion that faces the front conical portion and the outer flaring portion and which extends parallel to a center axis of the internal cylinder; and an inner flaring portion that starts flaring at a position between a maximum width portion and a trailing edge of the tubular strut.

2. The exhaust diffuser according to claim 1, wherein part of the external cylinder and part of the internal cylinder are formed integrally with the tubular strut by casting.

3. An exhaust diffuser comprising:

an internal cylinder;

an external cylinder that forms an exhaust passage between the internal cylinder and the external cylinder, the exhaust passage expanding from front to rear; and at least one tubular strut that couples the internal cylinder and the external cylinder together, wherein the external cylinder includes:

a front conical portion that is positioned forward of the tubular strut;

an outer flaring portion that starts flaring at a positon forward of the tubular strut at an inclination angle that is greater than an inclination angle of the front conical portion;

an outer straight portion that extends rearward from a rear end of the outer flaring portion beyond the maximum width portion of the tubular strut; and a rear conical portion that expands in diameter from a rear end of the outer straight portion, and the internal cylinder includes:

a front straight portion that faces the front conical portion and the outer flaring portion;

an inner flaring portion that starts flaring at a position between a maximum width portion and a trailing edge of the tubular strut; and a rear straight portion that extends rearward from a rear end of the inner flaring portion.

4. An exhaust diffuser comprising:

an internal cylinder;

an external cylinder that forms an exhaust passage between the internal cylinder and the external cylinder, the exhaust passage expanding from front to rear; and at least one tubular strut that couples the internal cylinder and the external cylinder together, wherein the external cylinder includes:

a front conical portion that is positioned forward of the tubular strut; and an outer flaring portion that starts flaring at a positon forward of the tubular strut at an inclination angle that is greater than an inclination angle of the front conical portion, and the internal cylinder includes:

a front straight portion that faces the front conical portion and the outer flaring portion; and an inner flaring portion that starts flaring at a position between a maximum width portion and a trailing edge of the tubular strut, and at least one flattened strut that couples the internal cylinder and the external cylinder together and that overlaps with the tubular strut in an axial direction of the exhaust diffuser.

5. The exhaust diffuser according to claim 4, wherein a leading edge of the flattened strut is positioned forward of a leading edge of the tubular strut, and a trailing edge of the flattened strut is positioned rearward of the maximum width portion of the tubular strut.

6. The exhaust diffuser according to claim 5, wherein the trailing edge of the flattened strut is positioned forward of the trailing edge of the tubular strut.

7. An exhaust diffuser comprising:

an internal cylinder;

an external cylinder that forms an exhaust passage between the internal cylinder and the external cylinder, the exhaust passage expanding from front to rear;

at least one tubular strut that couples the internal cylinder and the external cylinder together; and at least one flattened strut that couples the internal cylinder and the external cylinder together and that overlaps with the tubular strut in an axial direction of the exhaust diffuser, wherein a leading edge of the flattened strut is positioned forward of a leading edge of the tubular strut, and a trailing edge of the flattened strut is positioned rearward of a maximum width portion of the tubular strut.

8. The exhaust diffuser according to claim 7, wherein the trailing edge of the flattened strut is positioned forward of a trailing edge of the tubular strut.

9. The exhaust diffuser according to claim 7, wherein part of the external cylinder and part of the internal cylinder are formed integrally with the tubular strut by casting.

10. The exhaust diffuser according to claim 2, wherein the external cylinder includes:

an outer straight portion that extends rearward from a rear end of the outer flaring portion beyond the maximum width portion of the tubular strut; and a rear conical portion that expands in diameter from a rear end of the outer straight portion, and the internal cylinder includes a rear straight portion that extends rearward from a rear end of the inner flaring portion.

11. The exhaust diffuser according to claim 2, further comprising at least one flattened strut that couples the internal cylinder and the external cylinder together and that overlaps with the tubular strut in an axial direction of the exhaust diffuser.

12. The exhaust diffuser according to claim 3, further comprising at least one flattened strut that couples the internal cylinder and the external cylinder together and that overlaps with the tubular strut in an axial direction of the exhaust diffuser.

13. The exhaust diffuser according to claim 8, wherein part of the external cylinder and part of the internal cylinder are formed integrally with the tubular strut by casting.

* * * * *